US007448469B2

(12) United States Patent
Seyler et al.

(10) Patent No.: US 7,448,469 B2
(45) Date of Patent: Nov. 11, 2008

(54) SILENCER

(75) Inventors: Andreas Seyler, Gründau (DE); Hans-Joachim Löwe, Wolfenbüttel (DE); Joachim Von Der Hagen, Linsengericht (DE); Helmut Stönner, Frankental (DE)

(73) Assignees: Veritas AG, Gelnhausen (DE); Borgwarner Inc., Auburn Hills, MI (US)

( * ) Notice: Subject to any disclaimer, the term of this patent is extended or adjusted under 35 U.S.C. 154(b) by 436 days.

(21) Appl. No.: 11/150,175

(22) Filed: Jun. 13, 2005

(65) Prior Publication Data

US 2005/0279568 A1 Dec. 22, 2005

(30) Foreign Application Priority Data

Jun. 14, 2004 (DE) ..... 10 2004 028 744

(51) Int. Cl.
*F01N 1/02* (2006.01)
*F01N 1/04* (2006.01)
*F01N 1/24* (2006.01)

(52) U.S. Cl. ..... 181/249; 181/250; 181/252

(58) Field of Classification Search ..... 181/249, 181/250, 252, 248, 255, 256; 285/299
See application file for complete search history.

(56) References Cited

U.S. PATENT DOCUMENTS

| | | | | | |
|---|---|---|---|---|---|
| 1,087,397 | A | * | 2/1914 | Persson | 181/276 |
| 1,542,829 | A | * | 6/1925 | Oldberg | 181/269 |
| 1,821,013 | A | * | 9/1931 | Hamilton | 181/266 |
| 1,909,394 | A | * | 5/1933 | Dodge | 181/249 |
| 2,014,368 | A | | 9/1935 | Blundell | |
| 2,138,510 | A | * | 11/1938 | Rauen | 181/273 |
| 2,184,891 | A | * | 12/1939 | Bourne | 181/273 |
| 3,212,603 | A | * | 10/1965 | Walker | 181/250 |
| 3,880,252 | A | * | 4/1975 | Mucka | 181/230 |
| 4,315,558 | A | * | 2/1982 | Katayama | 181/227 |
| 4,350,223 | A | | 9/1982 | Takei | |
| 4,645,032 | A | * | 2/1987 | Ross et al. | 181/250 |
| 4,979,587 | A | * | 12/1990 | Hirt et al. | 181/213 |
| 5,444,196 | A | * | 8/1995 | Woods | 181/227 |
| 5,603,358 | A | | 2/1997 | Lepoutre | |
| 5,979,598 | A | * | 11/1999 | Wolf et al. | 181/272 |
| 6,386,316 | B1 | | 5/2002 | Lepoutre | |
| 6,715,580 | B1 | * | 4/2004 | Gerstner et al. | 181/224 |
| 2005/0067220 | A1 | | 3/2005 | Keller et al. | |
| 2005/0150718 | A1 | * | 7/2005 | Knight et al. | 181/250 |

FOREIGN PATENT DOCUMENTS

| | | | |
|---|---|---|---|
| DE | 3431078 | A1 | 3/1985 |
| DE | 90 15 414.2 | U1 | 1/1991 |
| DE | 195 04 223 | A1 | 8/1996 |
| DE | 196 38 304 | A1 | 4/1997 |
| DE | 103 41 319 | A1 | 4/2005 |
| EP | 1 469 186 | A2 | 10/2004 |

* cited by examiner

*Primary Examiner*—Edgardo San Martin
(74) *Attorney, Agent, or Firm*—Buchanan Ingersoll & Rooney PC

(57) ABSTRACT

The invention relates to a silencer comprising an inner component and an outer component surrounding said inner component, said inner component defining an inner wall provided with openings and said outer component defining an outer wall extending along said inner wall. For improving the silencing characteristics as well as the flexibility of the silencer, the outer wall is implemented as a bellows which defines together with the inner wall individual cavities, the openings of the inner wall opening into said cavities. Furthermore, the outer wall is produced from a material having a density of at least 1.5 g/cm$^3$.

47 Claims, 1 Drawing Sheet

SILENCER

FIELD

The invention relates to a silencer comprising an inner component and an outer component surrounding said inner component, said inner component defining an inner wall provided with openings and said outer component defining an outer wall extending along said inner wall.

BACKGROUND

A silencer of this type is known from DE 195 04 223 A1.

Silencers are used in the intake system of engines, e.g. in motor vehicles, for reducing sound emissions. German-Offenlegungsschrift 34 31 078 suggests for this purpose a silencer consisting essentially of an intake pipe which is produced from a sound-absorbing porous material in a certain section thereof, the intake pipe being surrounded by a perforated metal tube in said section. The above-described silencer does not satisfy the demands on the degree of silencing, which are higher than they used to be. Particularly problematic is the silencing of the noise of engines provided with exhaust-driven turbocharger systems. When such turbocharger systems are in operation, pulsation noise is caused, said pulsation noise being generated by minute geometric irregularities of a compressor impeller of the turbocharger. This pulsation noise occurs proportionally to the rotational frequency of the exhaust-driven turbocharger. The frequency band excited is here very large in view of the large range of operating speed. It follows that sound damping over a particularly broad band is here necessary so as to achieve a general reduction of sound emission.

In DE 195 04 223 A1it is suggested that the perforated tube should be used as an intake pipe which is surrounded by a cylinder having a closed, plane surface. Between the inner, perforated intake pipe and the cylinder which concentrically surrounds said intake pipe, a broad continuous annular gap is formed. The openings provided in the perforated intake pipe are arranged in the area of said annular gap, so that said annular gap can communicate with the interior of the intake pipe. The improved silencing characteristics of this silencer are based on air mass exchange and pressure compensation with the annular gap, which can take place through the openings in the intake pipe; the cylinder, which forms the annular gap, prevents pressure losses and causes a further reduction of noise emission. However, not even the silencing degree of this silencer suffices to achieve a broad-band reduction of noise emission especially in the case of supercharged engines.

DE 196 38 304 A1 discloses a silencer which is specially designed for engines provided with turbochargers. This silencer comprises a chamber which is arranged in the flow passage and which is provided with a plurality of annular orifice plates that are arranged in parallel, spaced relationship with one another. Between two neighbouring annular orifice plates, a respective resonance chamber is formed, which leads to sound reduction in a specific frequency range. This silencer has the disadvantage that the orifice plates have edges which are located in the flow path of the gas. The flow resistance caused by these edges impairs the efficiency of the turbocharger system. In addition, the insertion of the orifice plates in the silencer chamber is complicated from the point of view of production technology and entails therefore high costs.

Furthermore, silencer systems are available and are also used in engines, in the case of which a plurality of different silencing elements are arranged in series, said silencing elements being configured for different frequency bands. Silencing systems of this type require, however, an excessive amount of installation space.

In the applicant's post-published prior application DE 103 41 319.7 a silencer is described, which comprises an inner component and an outer component arranged on the outer side of said inner component, said inner component being perforated and said outer component being implemented as a bellows. This kind of silencer has excellent, in particular broadband silencing characteristics.

SUMMARY

It is the object of the present invention to provide a silencer having optimized silencing characteristics, especially with respect to the silencer described in the above-mentioned application.

According to the present invention, further sound-absorbing measures are taken, in addition to the structural designs of the inner and outer components of the silencer specified in the above-mentioned application, said sound-absorbing measures leading to an optimization of the absorption behaviour of the silencer and thus to a further reduction of sound emissions.

In order to achieve this, the outer wall and/or the inner wall of the silencer according to claim 1 is/are produced from a material having a density of at least 1.5 g/cm$^3$. It turned out that a density of at least 1.5 g/cm$^3$ leads to a great improvement of the absorption characteristics of the outer wall and of the inner wall, respectively. The upper limit of the density range is, in general, determined by the producibility of the material and the economically justifiable expense.

Alternatively, it is suggested that a sound-absorbing outer skin should be provided on the outer wall of the silencer according to the present invention. Also this laminate-like structure improves the silencing behaviour of the silencer.

According to another alternative, the silencer according to the present invention is provided with a means for stiffening the outer wall, whereby sound-transmitting vibrations of the outer wall are reduced. Also this measure leads to a reduction of sound emission.

Furthermore, an improvement of the silencing characteristics is, alternatively, achieved in that, the outer wall and/or the inner wall of the silencer according to the present invention have/has a patterned surface.

In addition to the above-explained improved properties, the above-mentioned silencers according to the present invention also offer the advantage that the operational principle of a Helmholtz resonator is combined with the operational principle of a $\lambda/4$ reflector so that low-frequency components as well as components having a higher frequency can be damped. The silencer according to the present invention allows an adjustment of a silencing frequency band in accordance with the noise which occurs in the respective case of use and which is to be damped. In addition, the silencer according to the present invention can be produced at a very reasonable price, since it is not necessary to install any special elements, such as orifice plates or backdrops.

The silencer according to the present invention necessitates only little installation space, since the inner component of the silencer is integrated in an elastomer portion which has to be provided in the charge air system anyhow. Furthermore, due to the bellows-like outer wall, the silencer according to the present invention combines the advantage of a flexible construction with good silencing characteristics.

According to a preferred embodiment of the silencer comprising an outer wall and/or an inner wall made of a high-density material, the density is at least 2.0 g/cm$^3$. It turned out that, in the case of a lower limit of 2.0 g/cm$^3$, particularly good silencing characteristics can be achieved on the basis of a comparatively low cost of material. The upper limit of the density range can be adjusted to a maximum value of 2.5 g/cm$^3$, in particular to 2.2 g/cm$^3$. Furthermore, the outer wall and the inner wall, respectively, can be produced from acrylate rubber (ACM), which is a particularly robust material that is resistant to environmental influences. In addition, a plastic material can be used, which comprises salts or oxides of the metals having an atomic number of at least 20, in particular at least 50, and/or carbon black as a filler. In this way, it is possible to adjust the density of material that is particularly suitable for the respective case of use.

For the silencer according to the present invention provided with a sound-absorbing outer skin on the outer wall, it turned out to be expedient when said outer skin is fixedly connected to the outer wall. A particularly stable silencer is obtained in this way. The outer skin may additionally have a patterned surface, whereby sound emission via the outer wall will be reduced. Furthermore, the outer skin can have a density which is higher than 1.5 g/cm$^3$, and in particular higher than 2.0 g/cm$^3$, whereby the sound-absorbing effect of the outer skin will be improved as well. An upper limit for the density range which proved to be particularly expedient is 2.5 g/cm$^3$, in particular 2.2 g/cm$^3$. A further possibility of improving the sound-absorbing properties of the outer skin is to implement said outer skin such that it has a foam-like structure.

Alternatively to the firm interconnection of outer skin and outer wall, the outer skin can be stretched over the outer wall and fixed to said outer wall at the ends thereof. This embodiment of the silencer according to the present invention comprising the outer skin can be produced in a particularly simple manner and at a particularly reasonable price. The outer skin can be produced from a smooth or corrugated plastic material, in particular from an elastomer, or from a corrugated metal. If necessary, a sealing can be provided between the outer skin and the outer wall; this sealing seals an air gap which may perhaps exist between the outer skin and the outer wall.

In the case of the silencer according to the present invention comprising a means for stiffening the outer wall so as to improve the silencing characteristics, the stiffening means may comprise a braid, in particular a braid of metal or plastic, which is applied to the outer wall. This braid suppresses vibrations of the outer wall, whereby the silencing characteristics of the component are improved still further. Furthermore, the stiffening means may comprise external ring elements which are arranged on wave bodies of the bellows, said wave bodies being profiled so as to fix said external ring elements. Also by means of these external ring elements, a confinement of the surface structure of the wall is achieved, which results in a further reduction of sound emissions. According to another preferred embodiment, the stiffening means may comprise interior ring elements which are arranged in the interior of the bellows on the wave bodies, whereby the individual pleats of the bellows are supported and the bellows in its entirety is stiffened, the highest possible flexibility of the bellows being maintained in the case of this embodiment.

According to a preferred embodiment, the bellows extends over the whole inner wall area provided with the openings. This guarantees that the synergistic effects resulting from the combination of two operational principles (Helmholtz resonator and $\lambda/4$ reflector) will be effective over the whole operating length and the whole operating sphere of the inner component.

According to and advantageous embodiment, the inner component comprises a tube or a pipe, which each have radial openings provided therein. This embodiment offers a particularly simple and reasonably priced possibility of producing the silencer.

The inner component may also comprise tube segments or pipe segments which each have radial openings provided therein. By means of the segmented inner component, a particularly good flexibility of the silencer is achieved.

The inner component is preferably thermally formed on the outer component. This makes it easier to produce the silencer, since a plurality of connection points and connection areas between the inner component and the outer component can be produced in one operation, i.e. during one heat treatment. The inner component may also be mechanically connected to the outer component.

According to another embodiment, the inner component is integrated in a quick coupling. The silencer can in this way be joined to connection members and connection lines, respectively, in a particularly simple and fast manner.

According to an advantageous embodiment, the outer component is flexible over the whole length of the inner component so that the silencer can fully be utilized as a flexible portion in the charge air system of an engine.

According to another preferred embodiment, the outer wall is arranged concentrically with the inner wall. By means of this embodiment, it is achieved that the cavities defined between the bellows and the inner wall have essentially the same shape and consequently the same volume. The outer wall may also be conical in shape, whereby the cavity volume of the bellows is modified in the longitudinal direction of the silencer.

Materials which proved to be expedient for the inner component and the outer component are NBR, CR, ECO, AEM, ACM, silicone and FPM. The inner component may also be produced from plastic material. The outer component and/or the inner component may comprise a pressure carrier, said pressure carrier being not necessary when the inner component is made of plastic material.

According to another preferred embodiment of the present invention, the bellows extends in the longitudinal direction of the silencer beyond the inner component. This means that a part of the bellows comes directly into contact with the gaseous medium conducted in the inner component.

BRIEF DESCRIPTION OF THE DRAWINGS

In the following, the present invention will exemplarily be described in detail with reference to the enclosed schematic drawings, in which.

DETAILED DESCRIPTION

Figure 3:
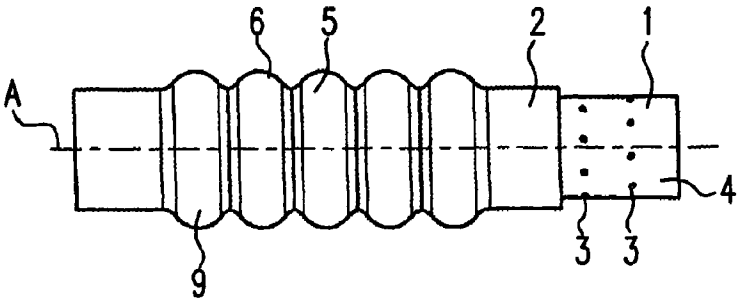
FIG. 3 shows a side view of the silencer according to FIG. 1, the inner component being partially inserted into the outer component.
Figure 2:
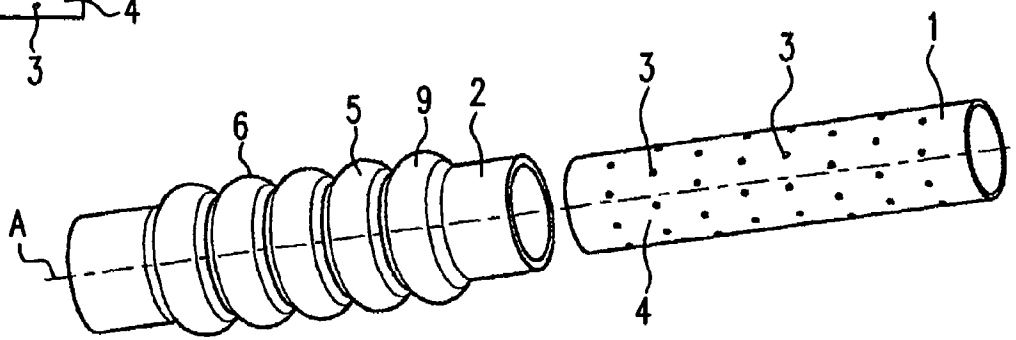
FIG. 2 shows an exploded view of the silencer according to FIG. 1.
Figure 1:
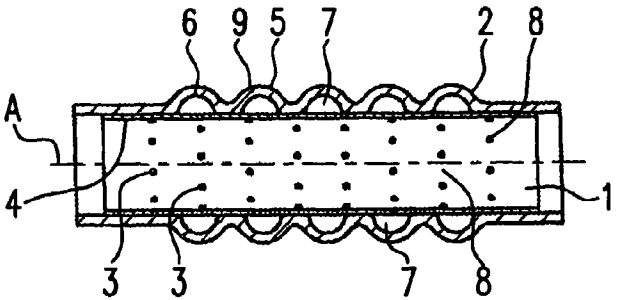
FIG. 1 shows a longitudinal section through a silencer according to one embodiment of the present invention.

The silencer shown in FIG. 1 to 3 is especially, but not exclusively designed for use in an internal combustion engine and arranged as closely as possible to the pressure-side discharge opening of a compressor housing of an exhaust-driven turbocharger. The silencer shown in FIG. 1 to 3 will, of course, produce a silencing effect also at other installation sites which are not located directly after the turbocharger.

As can best be seen from FIG. 1, the silencer comprises an inner component 1 which is inserted in an outer component 2 so that said outer component 2 surrounds the inner component 1. In the longitudinal direction A of the silencer, said inner component 1 comprises an air inlet and an air outlet as well as connection areas having connected thereto downstream or upstream components, such as charge-air tubes.

The inner component 1 is implemented as a perforated flexible tube and the outer component 2 as a bellows-like tube so that the whole silencer has flexible properties. The inner component 1 may also be implemented as a rigid pipe.

As can additionally be seen from FIG. 1, the inner component 1 forms an inner wall 4 having provided therein radial openings 3. The openings 3 are arranged in parallel rows 8 extending in the circumferential direction of said inner wall 4, i.e. each row 8 of openings 3 defines a circle, which has a radius that corresponds to the radius of the inner wall 4 and which is arranged at right angles to the longitudinal axis A of the silencer. The number of openings 3 per row may vary, an advantageous number of openings 3 being eight to twelve. A smaller or a larger number of openings 3 per row 8 is possible as well.

As can additionally be seen from FIG. 1 to 3, the outer wall 5, which surrounds the inner wall 4, is implemented as a bellows 6. In the joined condition, i.e. when the inner component 1 is arranged within the outer component 2, the bellows 6 defines together with the inner wall 4 individual cavities 7. These cavities 7 extend parallel to one another in the circumferential direction of the inner wall 4.

In the example shown, the bellows 6 is implemented as a tube having a wave-shaped profile; a pleat 9—with the exception of the outermost pleats—is delimited by two wave troughs and a wave body. As can be seen in FIG. 1, the cavities 7 defined in the respective wave bodies of the pleats 9 are laterally delimited from one another by wave troughs extending circumferentially in the peripheral direction.

In the present example, the pleats 9 abut on the inner wall 4 in the area of the wave troughs. The individual cavities 7 are therefore sealed from one another.

As can best be seen in FIG. 1, each row 8 of openings 3 is associated with a cavity 7. This means that the radial openings 3 of a row 8 are arranged in such a way that they open into a respective one of the cavities 7. It will be expedient to arrange a row 8 of openings 3 concentrically with the wave crest of the associated pleat 9. It is also imaginable to arrange a row 8 such that it is displaced relative to the wave crest of a pleat 9, provided that it is guaranteed that the openings 3 in said row 8 open into the associated cavity 7. As shown in connection with FIG. 1, the bellows 6 is provided along the whole perforated portion of the inner wall 4 where it forms the cavities 7 which communicate with the interior of the inner component 1 through the openings 3. This guarantees that the excellent silencing characteristics will be effective over the whole operative length of the inner component 1.

As can additionally be seen in FIG. 1 to 3, the openings 3 of neighbouring rows 8 are displaced relative to one another in the circumferential direction in such a way that a respective opening 3 of one row 8 is arranged centrally between two openings 3 of the respective neighbouring row 8.

The depicted number of pleats 9 and rows 8 of openings 3 is to be considered exemplary. A higher or a lower number, in extreme cases only a single pleat 9 is possible.

The overall shape of the outer component 2 is substantially cylindrical in the example shown; the circumferential surface, i.e. the outer wall 5, is not plane but implemented as a bellows 6. This means that the respective pleats 9 of the bellows 6 have identical diameters and, due to the corresponding geometry, also identical volumes.

It is, however, also possible to give the outer wall 5 a conical shape. In the case of this structural design, the diameter of the outer wall 5 increases along the longitudinal axis A of the silencer so that also the diameter of the individual pleats 9 and consequently the volume of said pleats will increase over the length of the silencer, whereby the silencing frequency range can be influenced. The conical shape of the outer wall 5 will additionally improve the demoulding properties of the outer component 2.

The geometry and the number of pleats 9 depends on the requirements with regard to silencing and flexibility that have to be satisfied in the respective case of use. It is imaginable to change e.g. the cavity volume, in particular the cavity depth, i.e. the distance between the inner wall 4 and the wave crest of a pleat 9, or the curve radius of the individual pleats 9.

The openings 3 in the inner wall 4 of the inner component 1 are implemented as radial openings with a circular cross-section in the present example. A different cross-sectional shape, e.g. oval openings, which extend in the radial direction is imaginable as well. It is also possible to implement the openings 3 as slot-shaped openings; in this case, a slot will extend in the circumferential direction in a subportion of the inner wall 4 in such a way that the slot opens into the associated cavity 7.

For maintaining the flexibility of the silencer, the inner component 1 may consist of a plurality of pipe segments or tube segments which are separate from one another. Each individual segment of the inner component 1 can be connected to the outer component 2 by means of a mechanical connection or a substance-to-substance bond. The inner component 1 can be connected to the outer component 2 by carrying out vulcanization once or several times. Mechanical fixing by means of clips or rings is possible as well. The inner component 1 can be fixed to the outer component 2 at both ends of the silencer or also at each individual pleat 9.

In addition, the inner component 1 may be implemented as an injection moulded part which is integrated in a quick coupling.

It is also possible to use an inner component 1 of reduced length so that the bellows 6 will extend in the longitudinal direction A of the silencer beyond the inner wall 4. This bellows section extending beyond the inner wall 4 is not covered by the inner component 1, whereby an influence on the silencing characteristics of the silencer will be achieved.

Materials that are adapted to be used as tube materials for the inner and the outer tube are NBR, CR, ECO, AEM, ACM, silicone and FPM. The inner component may also be produced from plastic material. If flexible tube materials are used, a pressure carrier will be employed. The use of a pressure carrier will be of advantage especially for the outer component 2. In the case of the inner component 1, a pressure carrier can be dispensed with, if said inner component is made of an elastomer. If said inner component 1 is made of a plastic material, no pressure carrier will be employed.

The silencing characteristics of the above-described silencer are improved still further due to the fact that the outer wall is made of a material having a density of at least 1.5 $g/cm^3$. A material that proved to be particularly advantageous is a material having a density of approx. 2.0 $g/cm^3$. The density can have a maximum value of 2.2 to 2.5 $g/cm^3$, the upper limit of the density range being primarily determined by the producibility and the production costs. Whereas it turned out that particularly good silencing characteristics can be achieved in the above-mentioned range of from 1.5 to 2.5 g/cm$^3$, acceptable values can also be expected in the tolerance range of the two range limits. The tolerance range may be e.g. ±0.5 g/cm$^3$. The material used for the outer wall is in the present case acrylate rubber (ACM); the present invention is, however, not limited to the use of this material. The desired density is adjusted by salts or oxides of the metals having an atomic number of at least 20, in particular of at least 50, which are added to the plastic material as a filler. Alternatively or additionally, it is also possible to use carbon black as a filler.

In accordance with a further embodiment of the silencer according to the present invention, the inner wall is produced from a material having a density of at least 1.5 g/cm$^3$, in particular 2.0 g/cm$^3$. Alternatively to or in addition to the use of such a high-density material, the inner wall may have a patterned surface for reducing sound emissions. The patterning of said surface contributes to an improved sound absorption, whereby sound energy is absorbed and converted into heat, the reflection of the absorbing surface being as low as possible. In order to achieve this, the surface is implemented such that it is as large as possible and has diffusely reflecting properties, in particular it is implemented as a porous and rough surface. This can be achieved e.g. by means of fibres (e.g. by flocking) or by a foam. Due to the simultaneously provided high inner damping, which is achieved by the use of a soft material for the inner wall, also the transmission of solid-borne sound between the inner wall and the outer wall will be impeded.

A material which is particularly suitable for producing the outer wall and the inner wall is sold by the applicant under the trade name HT ACM 185.

Figure 4:
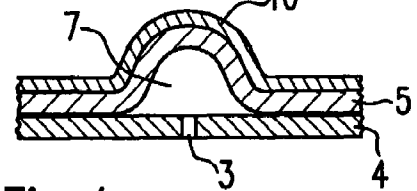
FIG. 4 shows a cross-section through one pleat of the bellows with the outer skin.

In accordance with a further embodiment, a sound-absorbing outer skin 10 is applied to said outer wall 5, as can be seen in FIG. 4, instead of or in addition to the selection of a high-density material for the outer wall 5. In said FIG. 4 it can be seen that the outer wall 5 and the outer skin 10 form a laminate, said outer skin 10 following the contour of the outer wall, i.e. the pleat profile of the bellows 6. The outer skin 10 is fixedly connected to the outer wall 5, said outer skin 10 being adapted to be applied to the outer wall 5 by means of extrusion, immersion or spraying. Furthermore, the outer skin can be implemented such that it has a foam-like nature, i.e. a certain degree of porosity.

The outer skin is made of a polymer material and has a temperature resistance of 100 to 200° C., preferably of more than 140° C.

The connection between the outer wall 5 and the outer skin 10 is established physically, chemically or mechanically. In any case it must be guaranteed that the outer skin 10 will always be able to follow the movements of the silencer originating from deflections of the components connected thereto and from pulsation.

Instead of a fixed connection between the outer skin 10 and the outer wall 5, the outer skin 10 may also be stretched over the outer wall 5 and only the ends thereof may be fixed to the outer wall 5 mechanically or chemically, i.e. a fixed connection does not exist between the sound-absorbing outer skin 10 and the outer wall 5 in the portion between the ends of said outer skin 10. The silencer according to this embodiment is therefore particularly easy to produce. The sound-absorbing, separate outer skin is here produced from a smooth or corrugated plastic material or elastomer, or from a corrugated metal. If necessary, the outer skin 10 and the outer wall 5 can be sealed by means of sealing elements. Means that are suitable to be used as sealing elements are e.g. sealing rings or a polymeric sealing compound.

Figure 5:
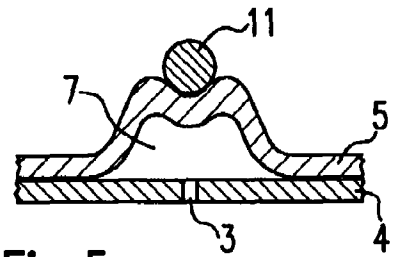
FIG. 5 shows a cross-section through one pleat of the bellows with the external ring element.

Another possibility of reducing sound emission is obtained in the case of the embodiment shown in FIG. 5 due to the fact that the surface of the outer wall 5 is fixed; this is done by means of external ring elements 11. These external ring elements 11 are arranged on the wave bodies of the bellows 6, as shown in FIG. 5. The wave bodies are profiled for fixing the external ring elements 11, especially for fixing them in the axial direction, i.e. each wave body has an indentation which extends in the circumferential direction and which serves to accommodate a respective external ring element 11. The bellows 6 is stiffened by means of the ring element 11, whereby the emission of sound will be reduced.

Each wave body can have associated therewith one external ring element 11. Alternatively, it is also possible to provide only a few of the wave bodies with external ring elements 11, e.g. every other wave body.

Instead of or in addition to the external ring elements 11, interior ring elements, which are here not shown, can be provided. The interior ring elements are arranged in the interior of the bellows 6 and abut on the inner side of the wave body so as to support and stiffen the bellows 6.

Elements which are suitable to be used as external ring elements and internal ring elements, respectively, are open steel rings and retainer rings, respectively, which produce a resilient effect and which are used for easier mounting and for adjusting the clamping forces acting on the wave bodies.

Instead of the ring elements, a braid of metal or of plastic material can be arranged on the whole surface of the outer wall, said braid being not shown in the present case. A stiffening of the bellows structure will be achieved also by means of this braid.

The measures for improving the silencing characteristics of the silencer can be combined with one another. The outer wall 5 may e.g. be produced from a material having a density of at least 1.5 g/cm$^3$. In addition, the outer wall 5 may be provided with a sound-absorbing outer skin, which is either fixedly connected to said outer wall 5 or stretched over said outer wall 5 and fixed only at the ends of said outer wall 5. The outer skin 10 may either be implemented such that it has a foam-like structure or it may have a patterned surface. The outer wall, which is produced from a high-density material, may be provided with a stiffening means instead of the outer skin. This stiffening means can comprise either a braid or external ring elements and/or internal ring elements. Furthermore, the inner wall can additionally by produced from a material having a density of at least 1.5 g/cm$^3$.

The silencer described is particularly suitable for reducing sound emissions which occur in supercharged Diesel or Otto engines. It goes without saying that the silencer can also be used in other fields where airborne sound is to be damped effectively.

The invention claimed is:

1. A silencer comprising an inner component and an outer component surrounding said inner component, said inner component defining an inner wall provided with openings and said outer component defining an outer wall extending along said inner wall, the outer wall comprising an elastomeric bellows which defines together with the inner wall individual cavities which are sealed from one another, the openings of the inner wall are associated with the individual cavities and opening into said cavities, and wherein at least one of the outer wall and the inner wall are formed from a material having a density of at least about 1.5 g/cm$^3$.

2. A silencer according to claim 1, wherein the density does not exceed about 2.5 g/cm$^3$.

3. A silencer according to claim 1, wherein at least one of the outer wall and the inner wall are produced from a plastic material comprising salts or oxides of at least one metal having an atomic number of at least 20.

4. A silencer according to claim 1, wherein at least one of the outer wall and the inner wall are produced from acrylate rubber (ACM).

5. A silencer comprising an inner component and an outer component surrounding said inner component, said inner component defining an inner wall provided with openings and said outer component defining an outer wall extending along said inner wall, wherein the outer wall comprises a bellows which defines together with the inner wall individual cavities, the openings of the inner wall opening into said cavities, and wherein a sound-absorbing outer skin is provided on said outer wall.

6. A silencer according to claim 5, wherein the outer skin is fixedly connected to the outer wall.

7. A silencer according to claim 5, wherein the outer skin has a patterned surface.

8. A silencer according to claim 5, wherein the outer skin has a density which is higher than about 1.5 g/cm$^3$.

9. A silencer according to claim 8, wherein the density is not higher than about 2.5 g/cm$^3$.

10. A silencer according to claim 5, wherein the outer skin has a foam-like nature.

11. A silencer according to claim 5, wherein the outer skin is stretched over the outer wall and fixed to said outer wall at the ends thereof.

12. A silencer according to claim 11, wherein the outer skin is produced from a smooth or corrugated plastic material.

13. A silencer according to claim 11, wherein a seal is formed between the outer skin and the outer wall.

14. A silencer comprising an inner component and an outer component surrounding said inner component, said inner component defining an inner wall provided with openings and said outer component defining an outer wall extending along said inner wall, wherein the outer wall comprises a bellows which defines together with the inner wall individual cavities, the openings of the inner wall opening into said cavities, and wherein means for stiffening the outer wall are provided.

15. A silencer according to claim 14, wherein the stiffening means comprises a braid of metal or plastic, which is applied to the outer wall.

16. A silencer according to claim 14, wherein the stiffening means comprises external ring elements which are arranged on wave bodies of the bellows, said wave bodies being profiled so as to fix said external ring elements.

17. A silencer according to claim 14, wherein the stiffening means comprises interior ring elements which are arranged in the interior of the bellows on the wave bodies.

18. A silencer comprising an inner component and an outer component surrounding said inner component, said inner component defining an inner wall provided with openings and said outer component defining an outer wall extending along said inner wall, wherein the outer wall comprises a bellows which defines together with the inner wall individual cavities, the openings of the inner wall opening into said cavities, and wherein at least one of the inner wall and the outer wall have a patterned surface.

19. A silencer according to claim 18, wherein the inner wall and/or the outer wall are produced from a material having a density of at least about 1.5 g/cm$^3$.

20. A silencer according to claim 19, wherein the density is not higher than about 2.5 g/cm$^3$.

21. A silencer according to claim 18, wherein the patterned surface is sound absorbing.

22. A silencer according to claim 1, wherein the bellows extends over the whole inner wall area provided with said openings.

23. A silencer according to claim 1, wherein the inner component comprises a tube or a pipe, which each have radial openings provided therein.

24. A silencer according to claim 1, wherein the inner component comprises tube or pipe segments which each have radial openings provided therein.

25. A silencer according to claim 1, wherein the inner component is thermally formed on the outer component.

26. A silencer according to claim 1, wherein the inner component is mechanically connected to the outer component.

27. A silencer according to claim 1, wherein the inner component is integrated in a quick coupling.

28. A silencer according to claim 1, wherein the outer component is flexible over the whole length of the inner component.

29. A silencer according to claim 1, wherein the outer wall is arranged concentrically with the inner wall.

30. A silencer according to claim 1, characterized wherein the outer wall is conical in shape.

31. A silencer according to claim 1, wherein the materials of the inner component and/or of the outer component comprise NBR, CR, ECO, AEM, ACM, silicone and FPM.

32. A silencer according to claim 1, wherein the inner component is produced from plastic material.

33. A silencer according to claim 1, wherein the outer component and/or the inner component comprise a pressure carrier.

34. A silencer according to claim 1, wherein the bellows extends in the longitudinal direction of the silencer beyond the inner component.

35. A silencer according to claim 1, wherein the density is at least about 2.0 g/cm$^3$.

36. A silencer according to claim 2, wherein the density is at least about 2.2 g/cm$^3$.

37. A silencer according to claim 3, wherein the plastic material comprises salts or oxides of at least one metal having an atomic number of at least 50.

38. A silencer according to claim 3, wherein the plastic material comprises a carbon black as a filler.

39. A silencer according to claim 8, wherein the density is greater than about 2.0 g/cm$^3$.

40. A silencer according to claim 9, wherein the density is not higher than about 2.2 g/cm$^3$.

41. A silencer according to claim 11, wherein the outer skin is formed from an elastomer.

42. A silencer according to claim 11, wherein the outer skin is formed from a corrugated metal.

43. A silencer according to claim 19, wherein the density is at least about 2.0 g/cm$^3$.

44. A silencer according to claim 20, wherein the density is not higher than about 2.2 g/cm$^3$.

45. A silencer comprising an inner component and an outer component surrounding the inner component, the inner component defining an inner wall provided with openings and the outer component defining an outer wall extending a long said inner wall, the outer wall comprising an elastomeric bellows which defines together with the inner wall individual cavities which are sealed from one another, the openings of the inner wall are associated with, and open into the cavities, at least one of the outer and inner walls formed from a material having a density of at least about 1.5 g/cm$^3$, but does not exceed about 2.5 g/cm$^3$, and at least one of the outer wall and the inner wall are formed from a plastic material comprising salts or oxides at least one metal having an atomic number of at least 20.

46. A silencer according to claim 45, wherein the plastic material comprises salts or oxides of at least one metal having an atomic number of at least 50.

47. A silencer according to claim 45, wherein the plastic material comprises carbon black as a filler.

* * * * *